US005987148A

United States Patent [19]

Hsieh

[11] Patent Number: 5,987,148

[45] Date of Patent: Nov. 16, 1999

[54] DRIVER FOR A HORN RADIATOR

[76] Inventor: Chen-Hugh Hsieh, No. 544, Min-Tsu Rd., Chia-I City, Taiwan

[21] Appl. No.: 09/170,533

[22] Filed: Oct. 13, 1998

[51] Int. Cl.[6] ..... H04R 25/00

[52] U.S. Cl. ..... 381/397; 381/340; 381/343; 381/412

[58] Field of Search ..... 381/396, 397, 381/340, 343, 412, FOR 152, FOR 143, FOR 159, FOR 161; 181/152, 159

[56] References Cited

U.S. PATENT DOCUMENTS 4,550,229 10/1985 Hwang ..... 381/340
5,894,524 4/1999 Kotsatos et al. ..... 381/397

*Primary Examiner*—Huyen Le
*Attorney, Agent, or Firm*—Kane, Dalsimer, Sullivan, Kurucz, Levy, Eisele and Richard, LLP

[57] ABSTRACT

A driver for use with a horn radiator includes a heat conductive hollow base that confines an upwardly opened cavity for receiving a yoke. The yoke has an outer wall surface that defines a first clearance with the base, and an inner wall surface which is formed with a through hole that extends to the outer wall surface. A permanent magnet is received in the yoke, and defines a second clearance with the inner wall surface of the yoke. A flux guiding plate is superimposed on the permanent magnet, and is disposed in the yoke to define a gap with the inner wall surface of the yoke. The second clearance is communicated fluidly with the first clearance via the through hole, and is in fluid communication with the gap. A diaphragm has a top portion disposed above the flux guiding plate, and an annular extension extending into the gap. A voice coil is connected to the annular extension of the diaphragm, and is disposed in the gap. An annular coupling member, which is adapted to be coupled to the horn radiator, is disposed above the diaphragm, and is secured to the base.

6 Claims, 3 Drawing Sheets

DRIVER FOR A HORN RADIATOR

BACKGROUND OF THE INVENTION

1. Field of the Invention

This invention relates to a driver for use with a horn radiator to form a loudspeaker, more particularly to a driver which is capable of dissipating heat in an effective manner to prevent overheating in order not to adversely affect the performance of the driver.

2. Description of the Related Art

FIG. 1 illustrates a conventional driver 1 for use with a horn radiator 50 to form a loudspeaker. The driver 1 includes an annular coupling member 11 for coupling with the horn radiator 50, a yoke 12 secured to the coupling member 11, a permanent magnet 22 disposed inside the yoke 12, a flux guiding plate 23 superimposed on the permanent magnet 22, a washer 24 disposed on the yoke 12 around the flux guiding plate 23 and forming a gap 241 with the flux guiding plate 23, a diaphragm 25 having a top portion 251 spread above the flux guiding plate 23 and an annular extension 253 extending downwardly from the top portion 251 into the gap 241, a voice coil 252 disposed in the gap 241 and wound around the annular extension 253 of the diaphragm 25, and an acoustic phase equalizer 26 disposed above the diaphragm 25 and secured to the coupling member 11. When an electric signal is transmitted to the voice coil 252, the diaphragm 25 vibrates to result in compression of air, thereby enabling the horn radiator 50 to generate a sound output. When the permanent magnet 22 is an Al-Ni-Co magnet or a ferrite magnet, it usually has a relatively large size in order to provide a magnetic field with a sufficient strength. Accordingly, the yoke 12 for receiving the permanent magnet 22 has a relatively large size, and thus, a relatively large space 13 is formed between the yoke 12 and the permanent magnet 22. Heat that is generated by the voice coil 252 during the operation of the driver 1 can be effectively dissipated via the large space 13 and the yoke 12. However, when a smaller-sized rare earth magnet is used instead of the permanent magnet 22 to reduce the size of the driver, the space between the rare earth magnet and the yoke becomes much smaller. Heat dissipation becomes less efficient as compared to that when the larger-sized magnet 22 is in use. In view of the fact that the rare earth magnet is generally very sensitive to temperature and that the magnetic field of the rare earth magnet weakens significantly as the surrounding temperature rises, it is particularly important to provide the driver with a heat dissipating capability in order to prevent overheating and prevent an adverse affect on the performance of the driver.

SUMMARY OF THE INVENTION

The main object of the present invention is to provide a horn radiator driver which is capable of dissipating heat in an effective manner to prevent overheating.

Accordingly, the driver of the present invention is adapted for use with a horn radiator to form a loudspeaker, and includes a heat conductive hollow base, a yoke, a permanent magnet, a flux guiding plate, a diaphragm, a voice coil and an annular coupling member. The base has an inner surrounding wall that confines a cavity with an open upper end. The yoke is received in the cavity of the base, and has an outer wall surface that defines a first clearance with the inner surrounding wall of the base, and an inner wall surface which is formed with a through hole that extends to the outer wall surface for fluid communication with the first clearance. The permanent magnet is received in the yoke, and has a periphery that defines a second clearance with the inner wall surface of the yoke. The second clearance is communicated fluidly with the first clearance via the through hole. The flux guiding plate is disposed in the yoke and is superimposed on the permanent magnet. The flux guiding plate has a periphery that defines a gap with the inner wall surface of the yoke. The gap is communicated fluidly with the second clearance. The diaphragm is mounted on the base at the open upper end of the cavity. The diaphragm has a top portion spread above the flux guiding plate, and an annular extension which extends downwardly from the top portion into the gap. The voice coil is connected to the annular extension of the diaphragm, and is disposed in the gap. The annular coupling member is disposed above the diaphragm, and is secured to the base. The coupling member is adapted to be coupled to the horn radiator.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 2:
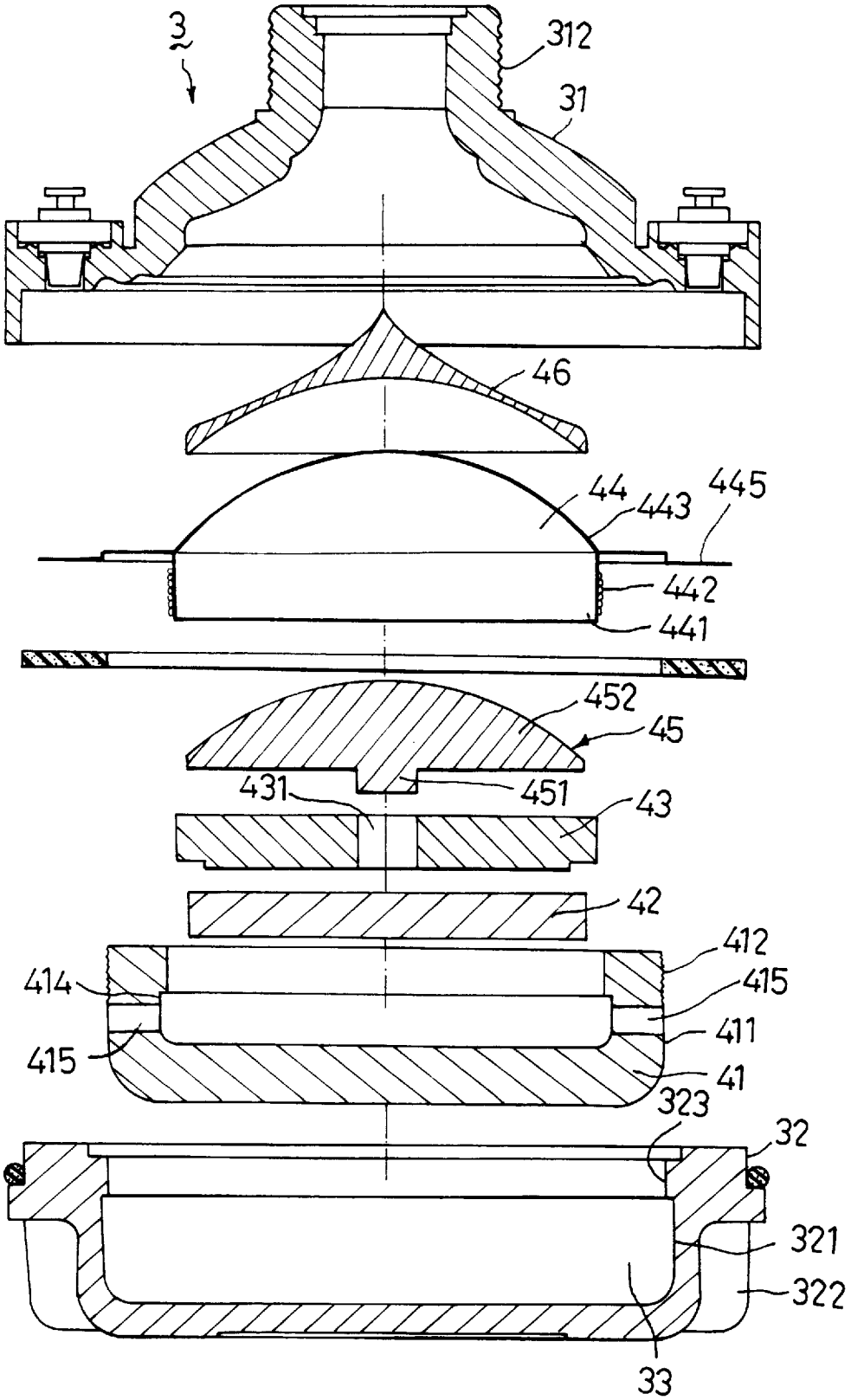
FIG. 2 is an exploded sectional view of a preferred embodiment of a driver according to the present invention.
Figure 3:
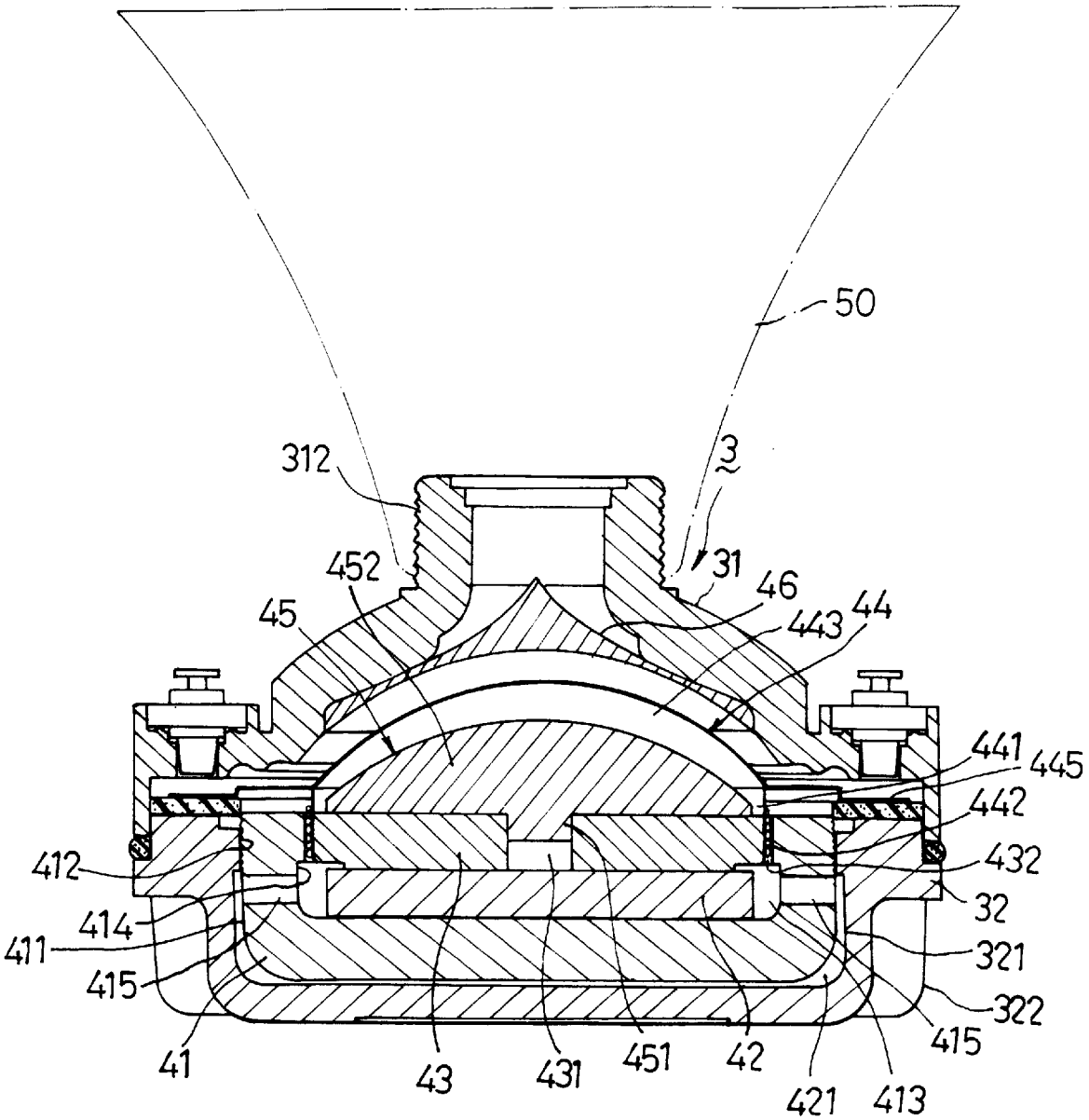
FIG. 3 is an assembled vertical sectional view of the driver of the preferred embodiment.

Referring to FIGS. 2 and 3, the preferred embodiment of the driver 3 according to the present invention is adapted for use with a horn radiator 50 to form a loudspeaker. The driver 3 is shown to include a hollow base 32, a yoke 41, a permanent magnet 42, a flux guiding plate 43, a heat dissipating member 45, a diaphragm 44, a voice coil 442, and an annular coupling member 31.

The base 32 is made of a heat conductive material, such as aluminum, and has an inner surrounding wall 321 that confines a cavity 33 with an open upper end, and an outer surrounding wall that is formed with a plurality of heat dissipating fins 322. The inner surrounding wall 321 of the base 32 has a retaining flange 323 which extends inwardly into the cavity 33.

The yoke 41 is received in the cavity 33 of the base 32, and has an outer wall surface 411 that tapers downwardly and that defines a first clearance 421 with the inner surrounding wall 321 of the base 32. The outer wall surface 411 has an embossed upper section 412 that is in friction contact with the retaining flange 323 of the base 32 for retaining the yoke 41 in the base 32. The yoke 41 further has an inner wall surface 414 which is formed with two opposite through holes 415 that extend to the outer wall surface 411 for fluid communication with the first clearance 421.

Figure 1:
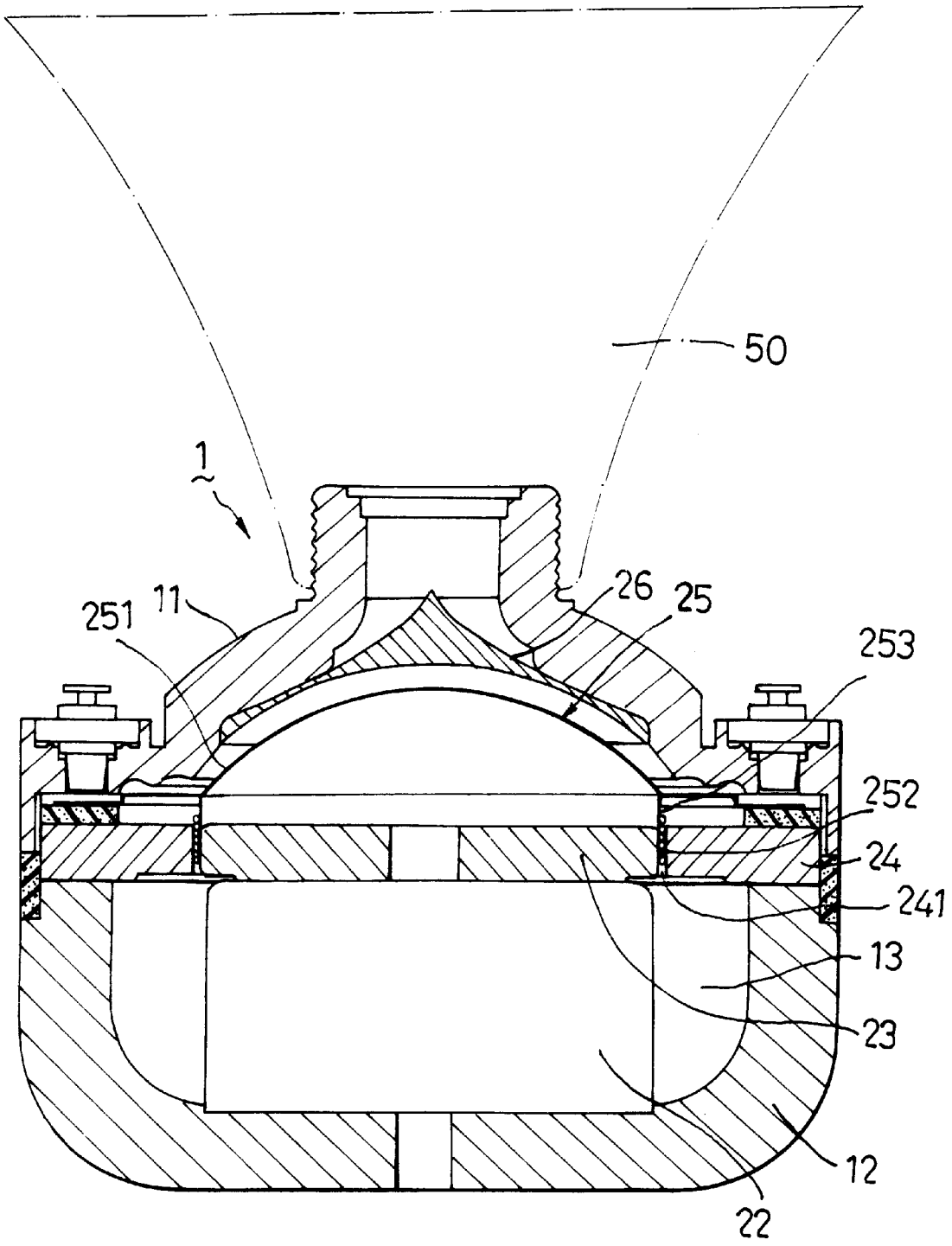
FIG.1 PRIOR ART
FIG. 1 is a vertical sectional view of a conventional driver for a horn radiator.

In the preferred embodiment, the permanent magnet 42 is a rare earth magnet, such as a samarium cobalt magnet or a neodymium magnet, and has a size much smaller than that of the permanent magnet 22 shown in FIG. 1. The permanent magnet 42 is received in the yoke 41, and has a periphery that defines a second clearance 413 with the inner wall surface 414 of the yoke 41 for fluid communication with the first clearance 421 via the through holes 415.

The flux guiding plate 43 is disposed in the yoke 41, and has a periphery that defines a gap 432 with the inner wall surface 414 of the yoke 41. The gap 432 is communicated fluidly with the second clearance 413. The flux guiding plate 43 is formed with a central hole 431.

The heat dissipating member 45 is made of a heat conductive material, such as aluminum. The heat dissipating member 45 has a convex top portion 452 superimposed on the flux guiding plate 43, and a downwardly projecting plug 451 which extends into the central hole 431 of the flux guiding plate 43 for positioning the heat dissipating member 45 on the flux guiding plate 43.

The diaphragm 44 is mounted on the base 32 at the open upper end of the cavity 33. The diaphragm 44 has a top portion 443 spread above the heat dissipating member 45, an annular extension 441 extending downwardly from the top portion 443 into the gap 432, and an annular flange 445 extending radially and outwardly from the top portion 443 for mounting on the base 32.

The voice coil 442 is connected to the annular extension 441 of the diaphragm 44, and is disposed in the gap 432.

The coupling member 31 is disposed above the diaphragm 44, and is secured to the base 32. An acoustic phase equalizer 46 is disposed above the diaphragm 44, and is secured to a bottom side of the coupling member 31. The coupling member 31 is formed with an external screw thread 312 so as to be adapted for coupling with the horn radiator 50.

When an electrical signal is transmitted to the voice coil 442, the voice coil 442 generates a magnetic field which cooperates with the magnetic field that is generated by the permanent magnet 42 to result in vibration of the diaphragm 44. At the same time, heat that is generated by the voice coil 442 can be transmitted from the gap 432 to the base 32 via the second clearance 413, the through holes 415 and the first clearance 421, and then dissipated from the driver 3 by the heat dissipating fins 322 of the base 32. In addition, the heat can be transmitted to the heat dissipating member 45, and then to the second clearance 413 by virtue of vibration of the diaphragm 44.

It has thus been shown that, with the provision of the first clearance 421, the second clearance 413, and the through holes 415, heat that is generated in the gap 432 can be effectively dissipated away from the driver 3 with the assistance of the heat dissipating fins 322 of the base 32 to prevent overheating of the driver 3. This is especially important when the permanent magnet 42 is a small-sized rare earth magnet, as illustrated in the preferred embodiment.

With this invention thus explained, it is apparent that numerous modifications and variations can be made without departing from the scope and spirit of this invention. It is therefore intended that this invention be limited only as indicated in the appended claims.

I claim:

1. A driver for use with a horn radiator to form a loudspeaker, comprising:

a heat conductive hollow base having an inner surrounding wall that confines a cavity with an open upper end;

a yoke received in said cavity of said base and having an outer wall surface that defines a first clearance with said inner surrounding wall of said base, said yoke further having an inner wall surface formed with a through hole that extends to said outer wall surface for fluid communication with said first clearance;

a permanent magnet received in said yoke and having a periphery that defines a second clearance with said inner wall surface of said yoke, said second clearance being communicated fluidly with said first clearance via said through hole;

a flux guiding plate disposed in said yoke and superimposed on said permanent magnet, said flux guiding plate having a periphery that defines a gap with said inner wall surface of said yoke, said gap being communicated fluidly with said second clearance;

a diaphragm mounted on said base at said open upper end of said cavity, said diaphragm having a top portion spread above said flux guiding plate, and an annular extension which extends downwardly from said top portion into said gap;

a voice coil connected to said annular extension of said diaphragm and disposed in said gap; and an annular coupling member disposed above said diaphragm and secured to said base, said coupling member being adapted to be coupled to the horn radiator.

2. The driver according to claim 1, further comprising a heat dissipating member disposed between said flux guiding plate and said top portion of said diaphragm.

3. The driver according to claim 2, wherein said flux guiding plate is formed with a central hole, said heat dissipating member having a convex top portion superimposed on said flux guiding plate, and a downwardly projecting plug which extends into and which engages said central hole of said flux guiding plate for positioning said heat dissipating member on said flux guiding plate.

4. The driver according to claim 1, wherein said base has an outer surrounding wall formed with a plurality of heat dissipating fins.

5. The driver according to claim 1, wherein said outer wall surface of said yoke has an embossed upper section, said inner surrounding wall of said base having a retaining flange that extends into said cavity and that is in friction contact with said embossed upper section of said outer wall surface of said yoke for retaining said yoke in said base.

6. The driver according to claim 1, wherein said permanent magnet is a rare earth magnet.

* * * * *